US010745235B1

(12) United States Patent
Kemper et al.

(10) Patent No.: US 10,745,235 B1
(45) Date of Patent: Aug. 18, 2020

(54) INSERTER HOPPER DEVICE

(71) Applicant: Newspaper Solutions, LLC, Vandalia, OH (US)

(72) Inventors: Daniel M. Kemper, Arlington Heights, IL (US); Sean M. Conway, Dearborn, MI (US)

(73) Assignee: Newspaper Solutions, LLC, Vandalia, OH (US)

( * ) Notice: Subject to any disclaimer, the term of this patent is extended or adjusted under 35 U.S.C. 154(b) by 0 days.

(21) Appl. No.: 16/615,672

(22) PCT Filed: Aug. 16, 2019

(86) PCT No.: PCT/US2019/046875

§ 371 (c)(1),
(2) Date: Nov. 21, 2019

(51) Int. Cl.
*B65H 39/04* (2006.01)
*B65H 3/08* (2006.01)

(52) U.S. Cl.
CPC ..... *B65H 39/04* (2013.01); *B65H 3/08* (2013.01); *B65H 3/0866* (2013.01)

(58) Field of Classification Search
CPC ..... B65H 3/08; B65H 3/0866; B65H 39/04
USPC ..... 270/52.14, 52.19, 52.2
See application file for complete search history.

(56) References Cited

U.S. PATENT DOCUMENTS 4,373,710 A 2/1983 Hansen et al.
4,456,241 A 6/1984 Newsome
4,925,174 A 5/1990 Bruce et al.
5,833,229 A * 11/1998 Prim ..... B65H 7/02 271/11
6,053,492 A * 4/2000 Newsome ..... B65H 3/10 271/105
6,168,148 B1 1/2001 Bechler et al.
6,390,461 B1 5/2002 Vitko, Jr. et al.
6,405,152 B1 6/2002 Hall et al.
6,554,268 B1 4/2003 Keller et al.
6,666,447 B2 12/2003 Keller
7,578,501 B2 8/2009 Noll, Jr. et al.
7,694,949 B2 4/2010 Keane et al.
7,703,770 B2 4/2010 Ito
(Continued)

OTHER PUBLICATIONS

International Search Report and Written Opinion dated Nov. 5, 2019 for International Application No. PCT/US19/46875, Filed Aug. 16, 2019.

*Primary Examiner* — Leslie A Nicholson, III
(74) *Attorney, Agent, or Firm* — Cook Alex Ltd.

(57) ABSTRACT

An inserter hopper device for handling a pile of inserts includes a framework, a belly plate that is connected to the framework, a carry-down cam assembly including a plurality of carry-down cams on a rotatable carry-down cam shaft having a fixed location relative to the framework and a carry-down roller assembly including a plurality of carry-down rollers on a rotatable carry-down roller shaft having a movable location relative to the framework. The carry-down rollers are opposed to and spaced from the carry-down cams, providing a nip having a nip distance therebetween. At least one biasing element biases the carry-down roller shaft toward the nip. The inserts are moved through the nip individually. A thickness tuning adjustment assembly moves the carry-down roller assembly to adjust the nip distance. A vacuum assembly is in communication with a movable sucker assembly that has sucker ports being movable toward and away from the nip.

20 Claims, 13 Drawing Sheets

(56) References Cited

U.S. PATENT DOCUMENTS

| | | | |
|---|---|---|---|
| 2004/0073330 | A1 | 4/2004 | Bader et al. |
| 2009/0212484 | A1 | 8/2009 | Kawaguchi et al. |
| 2014/0352561 | A1 | 12/2014 | Rosenberg |

* cited by examiner

INSERTER HOPPER DEVICE

CROSS-REFERENCE TO RELATED APPLICATION

This application is a U.S. National Stage of International Patent Application No. PCT/US18/46875 filed Aug. 16, 2019, the disclosure of which is incorporated by reference herein in its entirety.

FIELD OF THE INVENTION

The present disclosure relates generally to product handling equipment used in printing and publishing processes. More specifically, this application relates to inserter hopper devices that are used on inserting and binding machines typically used in the process of inserting products, referred to herein as inserts, into newspapers or other publications that are printed and assembled on high speed equipment.

BACKGROUND

The newspaper industry has utilized equipment to add inserts while assembling newspapers or other publications for decades. Dating back to the 1950's, the equipment has included classic newspaper inserter hopper devices, which sit atop high speed inserting and binding machines. The inserts may be constructed of a variety of sheet materials, but commonly are paper products that may range, for example, from very thin sheets to card stock.

Inserter hopper assemblies are used, for example, to feed individual inserts to inserting machines that place one or more different inserts within a newspaper or other publication, as the newspaper or publication is being advanced through high speed publishing equipment. However, the classic inserter hopper devices disadvantageously require significant maintenance and time and effort to be setup to accommodate a given insert and/or when changing from one insert to another. For example, it is not uncommon for past designs to require up to 30 minutes to properly setup an individual inserter hopper device, and there may be several inserter hopper devices sitting above a given inserting or binding machine.

Prior inserter hopper devices also had many proprietary parts and very high power consumption. For instance, past designs incorporated heavy compression springs to operate grippers on a drum assembly to pull an individual insert from the bottom of a pile of inserts. Those designs required more than 50 pound-feet of torque to drive the moving components of the inserter hopper device, and significant power was consumed in providing the high level of torque.

SUMMARY

The present disclosure provides an inserter hopper device that overcomes the inherent disadvantages of prior art inserter hopper devices by providing ease of setup, ease of maintenance, fewer proprietary parts and a significant reduction of power consumption. For instance, the example inserter hopper device disclosed herein is designed to allow a qualified individual to perform all of the necessary setup procedures for an individual inserter hopper device in less than one minute, as opposed to the 30 minutes required by a prior art inserter hopper device. Thus, the present inserter hopper device provides a substantial reduction in setup time over past designs. As such, the disclosure includes an advantageous method of setting up an inserter hopper device to handle a selected pile of inserts and a method of operation of an inserter hopper device.

Every aspect of the design of the new inserter hopper device also results in an easier process for routine maintenance. Subassemblies are designed such that wear items can be replaced without removing the inserter hopper device from the inserter or binding machine to which it may be connected. The majority of the wear items are available commercially, keeping proprietary spare parts costs to a minimum.

Also, total power consumption with the new inserter hopper device is reduced by approximately 90%. While the past designs required more than 50 pound-feet of torque to drive the moving components of the inserter hopper device to operate the grippers on a drum assembly to pull an individual insert from the bottom of a pile of inserts, the new design utilizes carry-down cams and carry-down rollers to accomplish the same task while requiring less than five pound-feet of torque to drive the moving components of the inserter hopper device.

In one aspect, the disclosure provides an inserter hopper device for handling a pile of inserts that includes a framework, a belly plate that is connected to the framework, a carry-down cam assembly including a plurality of carry-down cams on a rotatable carry-down cam shaft having a fixed location relative to the framework, a carry-down roller assembly including a plurality of carry-down rollers on a rotatable carry-down roller shaft having a location that is movable relative to the framework in the fore and aft directions. The plurality of carry-down rollers are opposed to and spaced from the plurality of carry-down cams so as to provide a nip having a nip distance between the respective plurality of carry-down rollers and plurality of carry-down cams, and the inserts are moved through the nip individually. At least one biasing element biases the movable carry-down roller shaft toward the nip, and a thickness tuning adjustment assembly moves the carry-down roller assembly so as to adjust the nip distance. Also included is a vacuum assembly that is in communication with a movable sucker assembly that has sucker ports being movable toward and away from the nip.

As above noted and explained further in the present disclosure, the example inserter hopper device and methods of setting up the inserter hopper device and operating the inserter hopper device provide several advantages over the prior art. It also is to be understood that both the foregoing general description and the following detailed description are exemplary and provided for purposes of explanation only, and are not restrictive of the claimed subject matter. Further features and objects of the present disclosure will become more fully apparent in the following description of the preferred embodiments and from the appended claims.

BRIEF DESCRIPTION OF DRAWINGS

In describing the preferred embodiments, reference is made to the accompanying drawing figures wherein like parts have like reference numerals, and wherein.

It should be understood that the drawings are not necessarily to scale. While some details of the example inserter hopper device and methods of setting up and operating the inserter hopper device, including potential alternative configurations, have not been included, such details are considered within the comprehension of those of skill in the art in light of the present disclosure. It also should be understood that the present invention is not limited to the example embodiments illustrated.

DETAILED DESCRIPTION OF THE PREFERRED EMBODIMENT

Figure 1:
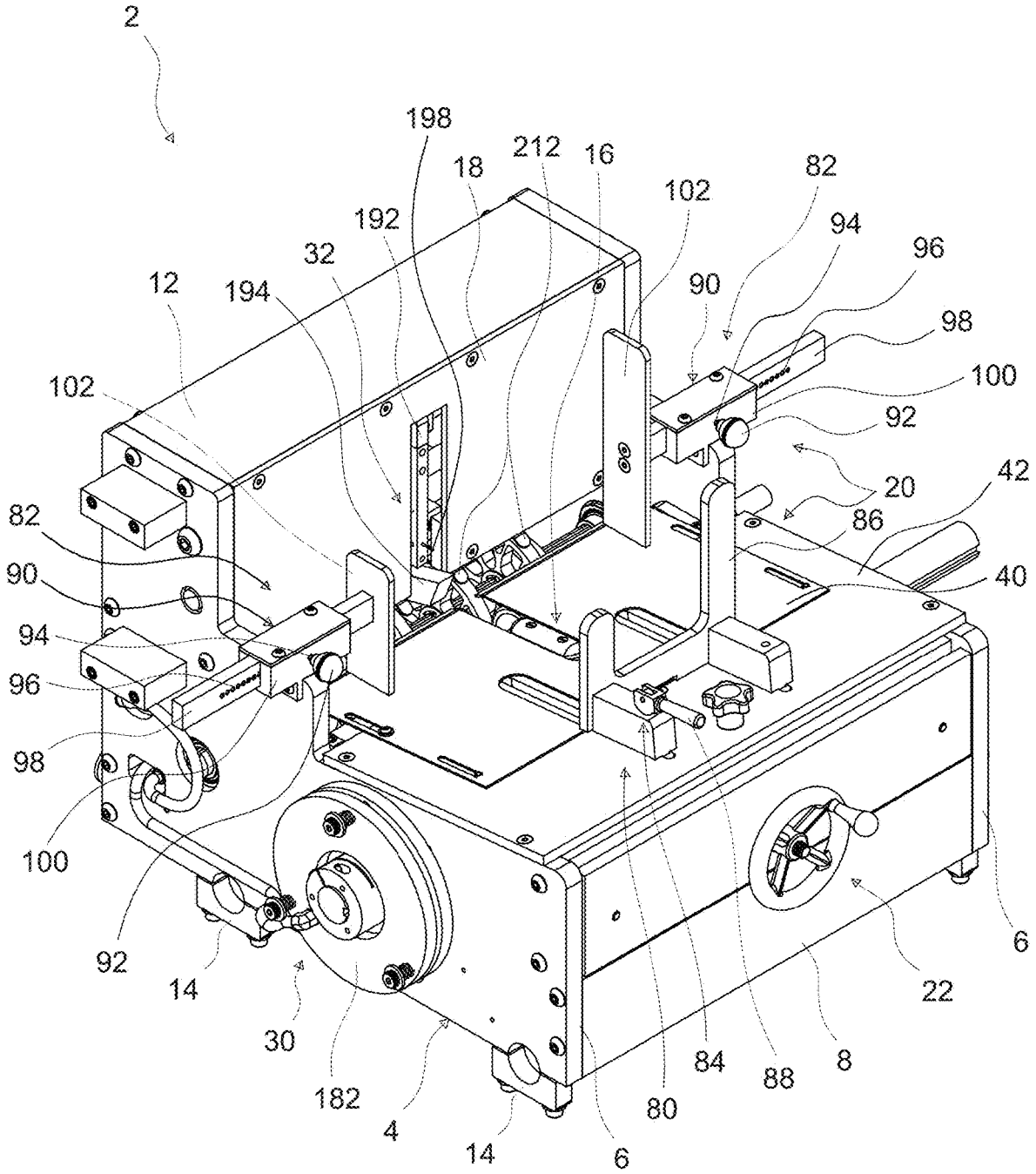
FIG. 1 is a front right upper perspective view of an example inserter hopper device for handling inserts in accordance with the present disclosure, and features portions of a framework, an adjustable belly plate and support plate, a front guide, a pile guide assembly, a front pile lift assembly and a stripper finger assembly, with the stated orientation of the inserter hopper device being based on the location of an operator facing a vacuum disk assembly and the side of the inserts, as opposed to the travel of the inserts.
Figure 2:
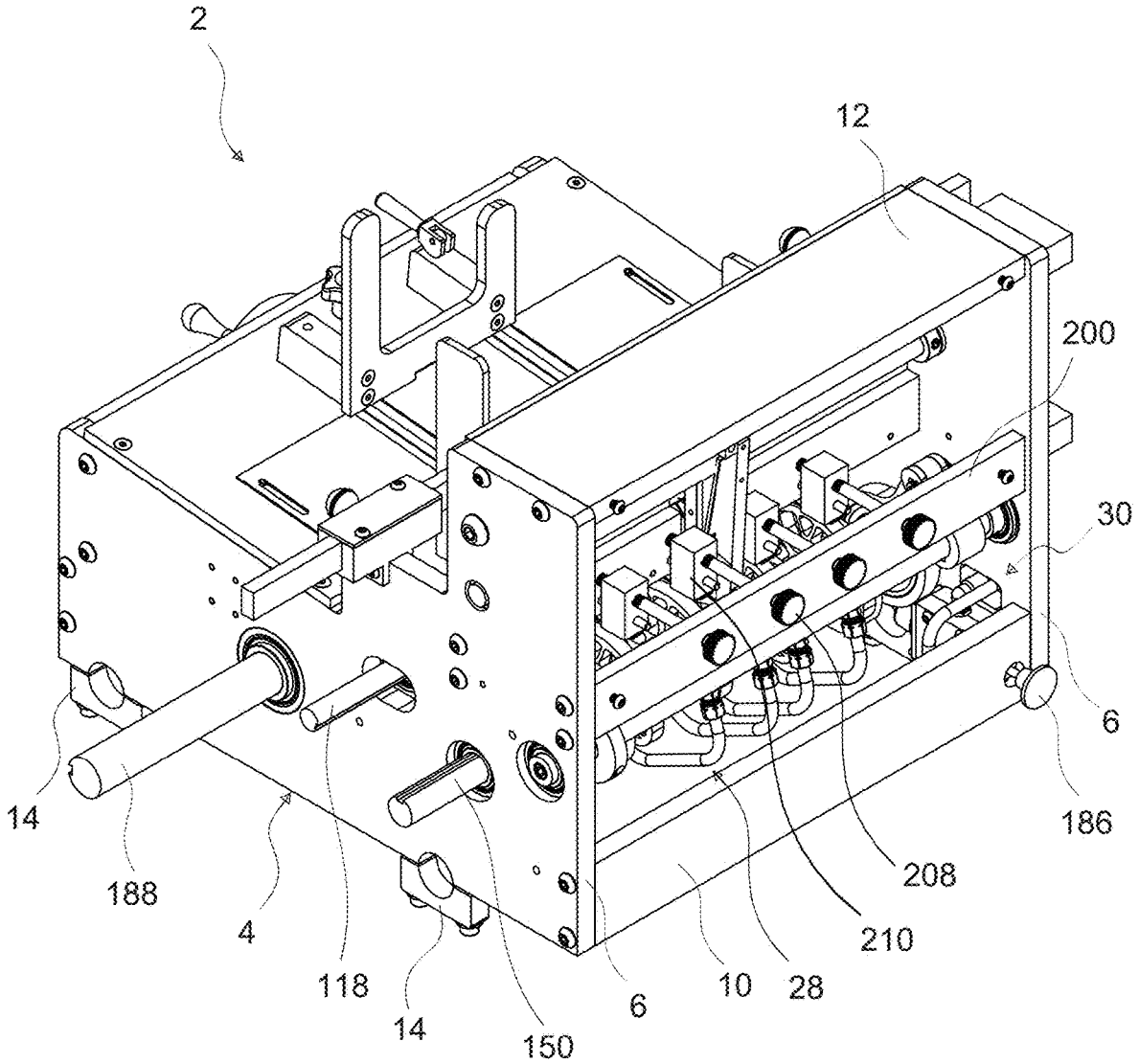
FIG. 2 is a rear left upper perspective view of portions of the inserter hopper device shown in FIG. 1, and additionally features portions of a sucker assembly.

Turning to FIGS. 1-15, an example inserter hopper device 2 of the present disclosure is shown and will be described. As seen in FIGS. 1 and 2, the inserter hopper device 2 includes a framework 4, which includes front and rear frames 6, a right cross frame 8, a left cross frame 10, a top cross frame 12 and lower mounting brackets 14. The various walls of the device 2 may be connected by removable fasteners, such as screws, or any other suitable means of securely fastening the walls together. The lower mounting brackets 14 permit the inserter hopper device 2 to be mounted to high speed inserting and binding machines for handling inserts (also referred to as an advertisement or a product), which will be distributed to publications running below and past the inserter hopper device 2. The framework 4 supports several components and assemblies that complement and work with each other to provide a substantially improved inserter hopper device 2. For example, the inserter hopper device 2 further includes an adjustable belly plate, a front saddle assembly 16 and a front guide 18 (relative to the direction of travel of the inserts), an insert pile guide assembly 20, a thickness tuning adjustment assembly 22, a carry-down cam assembly 24, a carry-down roller assembly 26, a sucker assembly 28, a vacuum and back blast assembly 30, a front pile lift assembly 32, and stripper finger assembly 34, all of which are described further herein.

Adjustable Belly Plate and Front Saddle Assembly

An adjustable belly plate and front saddle assembly 16 is best seen in FIGS. 1 and 7-9. The primary purpose of the adjustable belly plate and front saddle assembly 16 is to create a stable platform for a pile of inserts, wherein each insert will be sequentially pulled from a bottom of the pile of inserts and moved to a position for insertion into a publication passing below the inserter hopper device 2. The adjustable belly plate and front saddle assembly 16 includes a belly plate 40, which is connected to the framework 4. In this example, the belly plate 40 is adjustably connected to a support plate 42. The support plate 42 is mounted atop the front and rear frames 6 of the inserter hopper device 2. Mounting of the support plate 42 preferably utilizes removable fasteners that are accessible from above the support plate 42, thus providing ease of disassembly and convenient access to service and maintain internal components of the inserter hopper device 2. As shown by example in FIG. 2, for further convenience, the support plate 42 alternatively may include key-hole type apertures to permit removal of the support plate 42 without fully removing the fasteners.

The belly plate 40 is adjustable in the fore and aft directions relative to the support plate 42, so as to be adjustable toward and away from the front of the pile of inserts that rests against the front guide 18. This adjustment of the belly plate 40 provides for optimum rigidity of the front of the pile of inserts, which assists in keeping the front edges of the inserts from prematurely falling into a nip 44. The nip 44 is a gap between a plurality of cams 46 of the carry-down cam assembly 24 and a corresponding plurality of rollers 48 of the carry-down roller assembly 26, as shown in FIGS. 3, 5, 10 and 13, which together are used to advance the insert.

Figure 7:
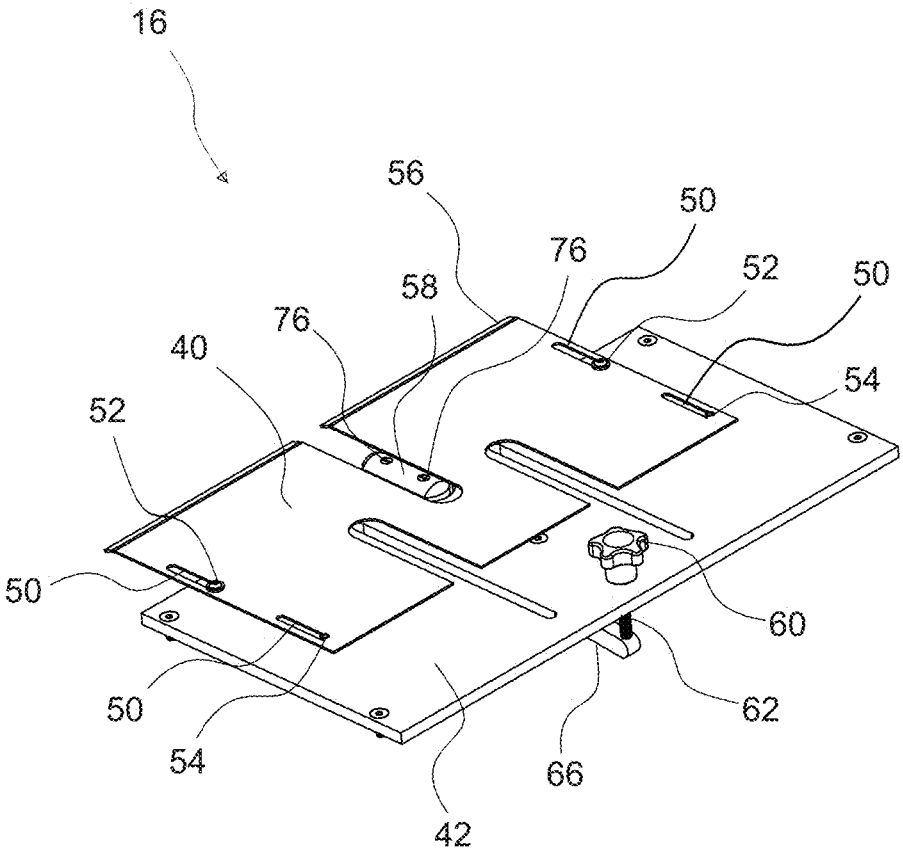
FIG. 7 is a front right upper perspective view of a portion of the inserter hopper device shown in FIG. 1, and features the adjustable belly plate and support plate.
Figure 8:
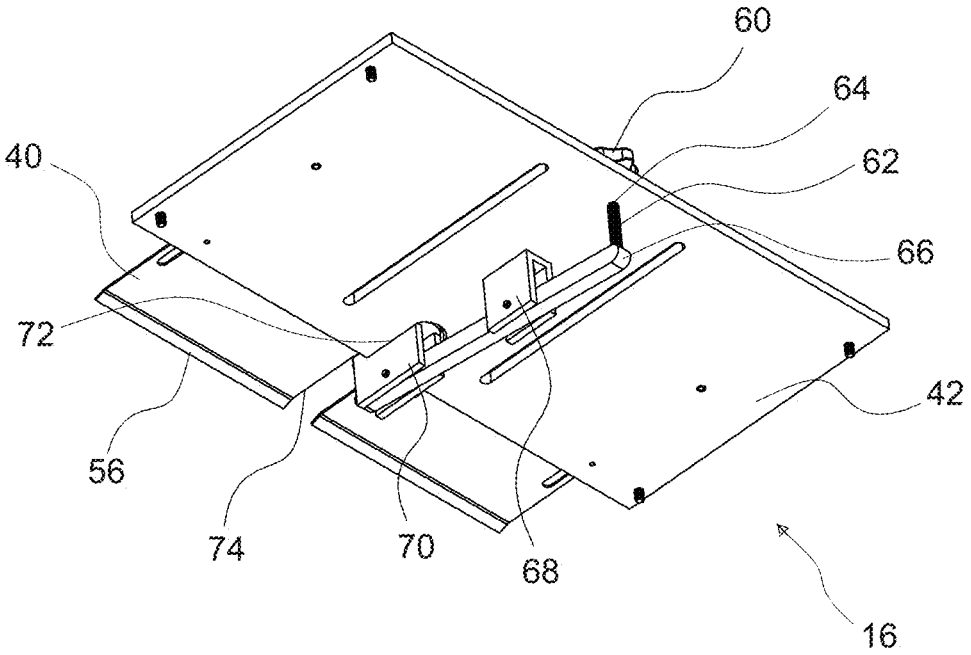
FIG. 8 is a front right lower perspective view of the portions of the inserter hopper device shown in FIG. 7.
Figure 9:
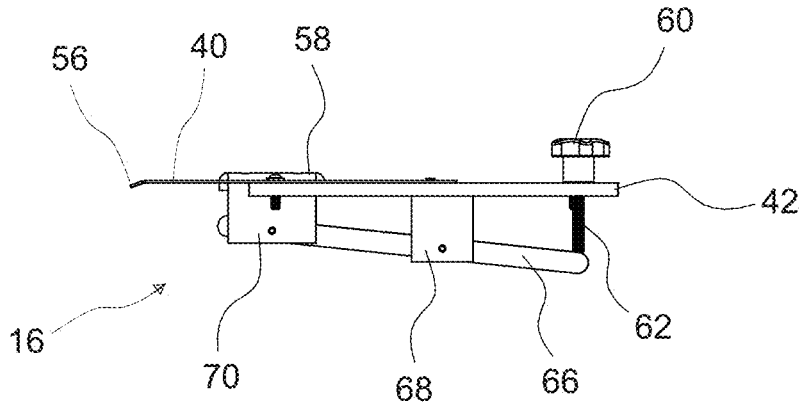
FIG. 9 is a front side view of the portions of the inserter hopper device shown in FIGS. 7 and 8.

Preferably, four slots 50 extend through the belly plate 40 and respectively slidably receive a pair of clamping screws 52 and a pair of fixed pins 54 that extend upward from the support plate 42. The clamping screws 52 and pins 54 remain in fixed guide positions and keep a front edge 56 of the belly plate 40, which is best seen in FIGS. 7-9, substantially parallel to the front of the pile of inserts. The clamping screws 52 may be tightened to hold the adjustable belly plate 40 in a desired fore and aft position relative to the support plate 42.

The belly plate 40 preferably is constructed so as to have a dimpled, polished metal top surface (shown simply as flat for convenience). A full pile of inserts may weigh several pounds, which can create a lot of friction for an insert at the bottom of the pile to overcome when being pulled forward from the bottom of the pile and through the nip 44. The dimpled top surface of the belly plate 40 creates a partial air-barrier between the top surface of the belly plate 40 and the bottom surface of the pile of inserts to reduce the amount of friction between the successive lowermost insert at the bottom of the pile of inserts and the belly plate 40.

The adjustable belly plate and front saddle assembly 16 includes a saddle 58 used to create more rigidity in the front of the pile of inserts by introducing a bow or saddle-shape in the bottom of the pile of inserts. This also helps prevent front edges of the inserts in the pile from prematurely falling into the nip 44. The height of the saddle 58 relative to the top surface of the belly plate 40 may be adjusted by turning a saddle adjustment knob 60, which is conveniently located rearward of the stack of inserts, relative to the direction of travel of the inserts. The adjustment knob 60 has a threaded stem 62 that threadably engages a threaded aperture 64 in the support plate 42. Turning the saddle adjustment knob 60 clockwise (when viewing the knob from above) causes the saddle 58 to rise, providing more of a bow in the bottom of the pile of inserts. Conversely, turning the saddle adjustment knob 60 counterclockwise (when viewing the knob from above) causes the saddle 58 to be lowered relative to the top surface of the belly plate 40, reducing the amount of bow in the front of the pile of inserts.

In this example, the stem 62 of the saddle adjustment knob 60 preferably is in constant contact with a first end of a saddle lift lever arm 66. The saddle lift lever arm 66 is pivotally connected at a location along its length to a saddle lift pivot collar 68, which is connected to the bottom of the support plate 42. The opposite end of the saddle lift lever arm 66 is connected to a saddle support bracket 70, which is connected to the saddle 58 and positions the saddle 58 to extend upward through an opening 72 in the support plate 42 and an opening 74 in the belly plate 40. The saddle support bracket 70 is pivotally connected to the opposite end of the saddle lift lever arm 66 to allow the saddle 58 to always be in full contact with the bottom of the pile of inserts. The saddle 58 is designed as a wear item, due to the inherently abrasive nature of the inserts, and is intended to be easily replaced. Thus, the saddle 58 may be removable, such as by use of fasteners, shown for example as two screws 76 that hold the saddle 58 to the saddle support bracket 70, although it will be appreciated that other forms of removable connection may be employed. The saddle 58 also may include different surface characteristics, from smooth to coarse, so as to add or reduce surface friction, as desired, relative to the bottom of the pile of inserts.

Insert Pile Guide Assembly

Figure 15:
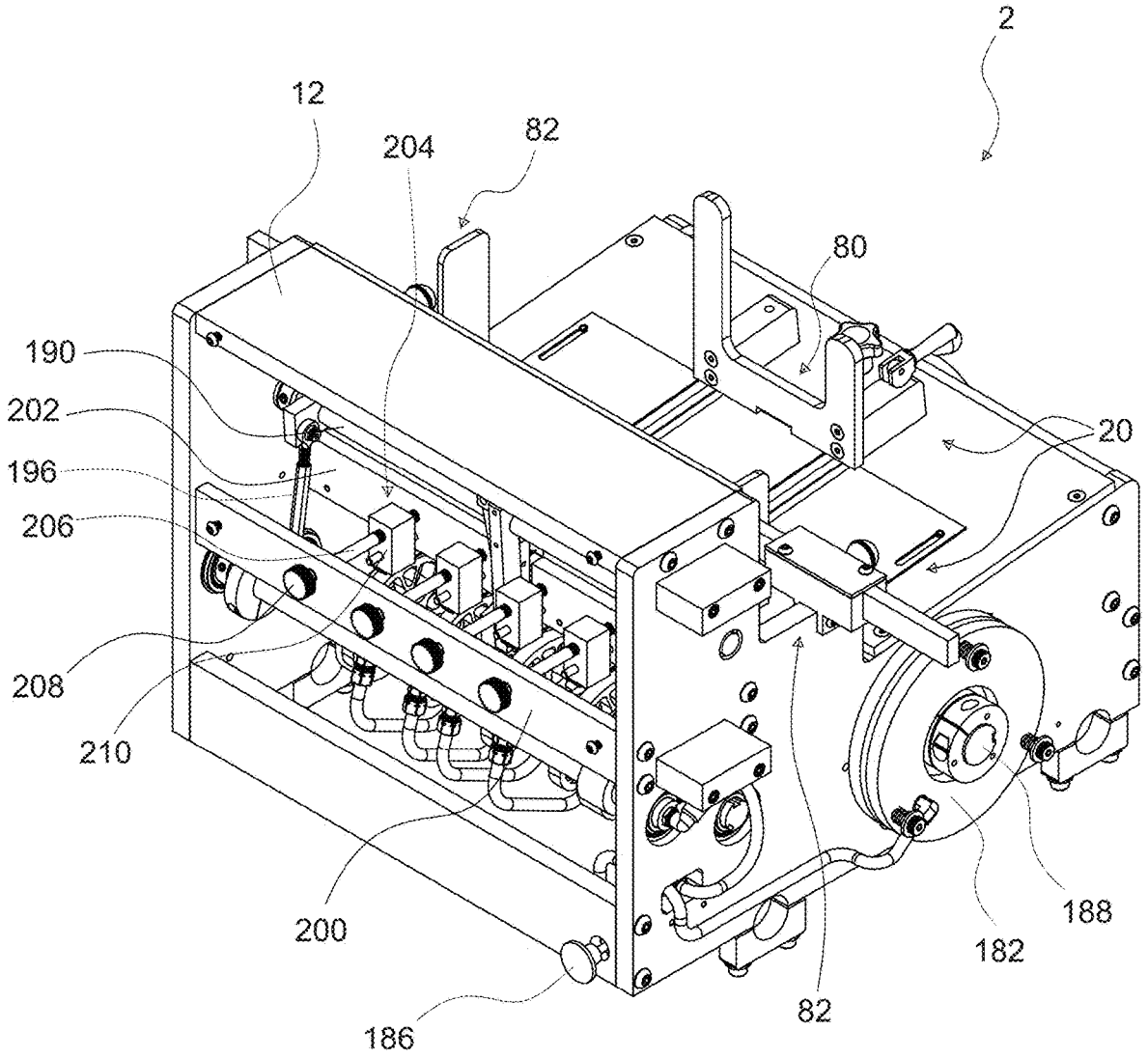
FIG. 15 is a front left upper perspective view of the inserter hopper device shown in FIGS. 1 and 2.

As best seen in FIGS. 1 and 15, an insert pile guide assembly 20, together with the front guide 18, effectively forms a receptacle having upright walls. The insert pile guide assembly 20 is adjustable to accommodate different insert sizes and is used to keep the pile of inserts properly located on and relative to the belly plate 40. The insert pile guide assembly 20 includes a rear guide 80 and side guides 82 (relative to the direction of travel of the inserts).

The rear guide 80 may be removably and adjustably connected to the belly plate 40. In this example, the rear guide 80 includes a locking mechanism 84, in the form of a positioning clamp, and a vertically extending rear guide plate 86. The locking mechanism 84 of this example includes a clamping lever 88 having a cam-shaped surface to provide clamping force. However, it will be appreciated that other locking mechanisms that use alternative clamping and/or fastening structures may be employed to adjustably locate the rear guide 80 relative to the belly plate 40. The example locking mechanism 84 allows for rapid location setting of the rear guide 80. The entire rear guide 80 of this example, when unlocked from the belly plate 40, is slidable to a desired location to provide a rear stop against which the inserts will rest, so as to facilitate the placement of subsequent stacks of inserts, which may be of a different size.

The side guides 82 preferably are removably and adjustably connected to the front and rear frames 6 of the framework 4 of the inserter hopper device 2. However, it will be appreciated that each side guide 82 preferably should be connected to a structure that is in a relatively fixed position, such that the side guides 82 alternatively may be configured for example to be connected to the support plate 42 or top cross frame 12. In this example, each side guide 82 utilizes a locking mechanism 90, in the form of a spring-loaded positioning knob 92 having a locating pin 94 that is received by one of a plurality of detents 96 on an adjustment arm 98. Each adjustment arm 98 is slidable within a side guide mounting base 100 that interacts with the spring-loaded positioning knob 92 and pin 94. Each adjustment arm 98 also has an upward extending side guide plate 102 connected to its inner end, so as to engage and assist in laterally aligning the pile of inserts. The locking mechanism 84 of the rear guide 80 and the locking mechanism 90 of each side guide 82 allow for rapid location setting of the rear guide 80 and each side guide 82. The detents 96, for example, may have centers spaced ¼" apart on each of the two adjustment arms 98. For improved adjustability, the adjustment arms 98 may be offset relative to each other and to a center of the pile of inserts, such as by ⅛". This allows for effective width adjustment of the side guides 82 in increments of ⅛" to accommodate inserts of different sizes. Advantageously, the rear guide 80 and each adjustment arm 98 and guide plate 102 may be quickly and completely removed to provide more convenient access to other components of the inserter hopper device 2 to facilitate maintenance or other servicing.

Thickness Tuning Adjustment and Carry-Down Roller Assemblies

The thickness tuning adjustment assembly 22 provides advantageous features and is best seen in FIGS. 3-6. A primary purpose of the thickness tuning adjustment assembly 22 is to enable quick setting of a nip distance at the nip 44 between the carry-down cams 46 and the carry-down rollers 48. The nip distance is defined as the distance between the two closest points between the tangents of the carry-down cams 46 and carry-down rollers 48. A back plate 110 is fixedly connected to the front and rear frames 6 of the inserter hopper device 2, such as by use of fasteners. By placing a portion of an insert that will be run through the inserter hopper device 2 between the back plate 110 and a movable plate 112, and then engaging a clamping mechanism 114, the actual thickness of an insert is used to set the nip distance for the nip 44. This helps to ensure proper gripping of the inserts for sequential insertion.

A secondary purpose of the thickness tuning adjustment assembly 22 is to substantially reduce the possibility of a jam, which might otherwise occur if more than one insert is fed through the nip 44 at any given time. In normal operation, the inserter hopper device 2 will feed one insert at a time through the nip 44 to below the device 2. When more than one insert is fed at a time through the nip 44 (usually due to inserts inadvertently sticking together), the entire thickness tuning adjustment assembly 22 is momentarily pushed rearward and away from the normal location of the nip 44, so as to let the unusual increased thickness pass through the nip 44, and then at least one biasing element 116, which in this example is shown in the form of two compression springs, immediately push the assembly back forward and into the previously selected position having the desired nip distance at the nip 44.

Figure 3:
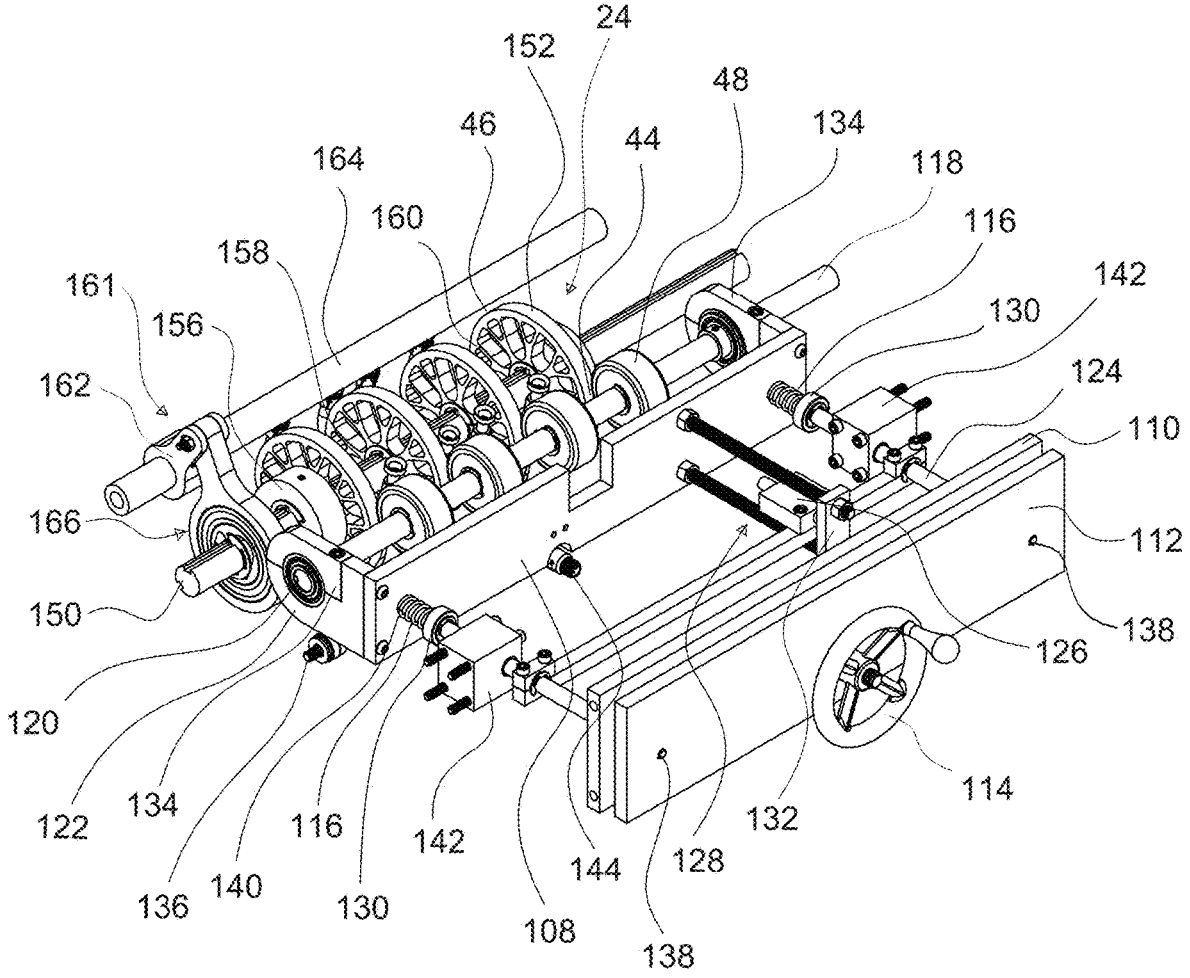
FIG. 3 is a front right upper perspective view of portions of the inserter hopper device shown in FIGS. 1 and 2, and features the thickness tuning adjustment assembly, a carry-down cam assembly and a carry-down roller assembly.

As seen in FIG. 3, within the carry-down roller assembly 26, the carry-down rollers 48 are mounted on a carry-down roller shaft 118, which is rotatably mounted in bearings 120. Each bearing 120 is held in a position relative to a carry-down roller shaft support plate 108, by a mounting bracket 122 having a bearing cap 134. Use of polymeric material for the carry-down rollers 48, such as polyurethane, reduces roller wear and the potential for buildup of ink, dust and other impurities, while also maintaining friction between the carry-down rollers 48 and the individual inserts that will pass through the nip 44 between the carry-down cams 46 and the carry-down rollers 48.

It will be appreciated in FIGS. 3-6 that the carry-down roller assembly 26 is designed to move as a whole, by sliding on side rods 124. In the event that two or more inserts inadvertently and simultaneously are moved into the nip 44, the increased thickness causes the carry-down roller assembly 26 to shift rearward, away from the nip 44, to prevent the multiple inserts from jamming in the nip 44. The compression springs 116 bias the carry-down roller assembly 26 and the thickness tuning adjustment assembly 22 forward, toward the nip 44. This enables the biasing element 116 to act as shock absorbers to dampen the rapid acceleration of the carry-down roller assembly 26 away from the nip 44 and to push it back forward, so as to reestablish the correct nip distance. The carry-down roller shaft support plate 108 of the carry-down roller assembly 26 also acts as a foundation for a multiple insert sensor 126 that is connected to a bridge 128 that spans between and is connected to the side rods 124. The compression springs 116 are seated against compression spring seats 130, which are fixed to the side rods 124. This structure keeps the compression springs 116 exerting essentially the same amount of biasing force against the carry-down roller shaft support plate 108, regardless of the nip distance at the nip 44. It will be appreciated that while compression springs were shown in this example, the at least one biasing element could be of an alternative configuration.

By using the bridge 128 to fix the multiple insert sensor 126 to the side rods 124 and adjusting the contact point of the multiple insert sensor 126 to be up against a stop plate 132 that is held just rearward of the sensor 126 and bridge 128, the sensor 126 is positioned to be activated by any rearward shift of the carry-down roller assembly 26, such as may be caused by an inadvertent incident of simultaneously feeding multiple inserts into the nip 44. When adjusted properly, the multiple insert sensor 126 should not require readjustment as part of the routine production setup of the inserter hopper device 2.

Also, in order to reduce the time and effort necessary to replace worn carry-down rollers 48, each of the brackets 122 that is connected to the carry-down roller support plate 108 and retains one of the bearings 120 and the carry-down roller shaft 118 is separable. Thus, the bearing cap 134 on each bracket 122 may be conveniently removed from above the carry-down roller assembly 26 to access and remove the carry-down roller shaft 118.

Figure 4:
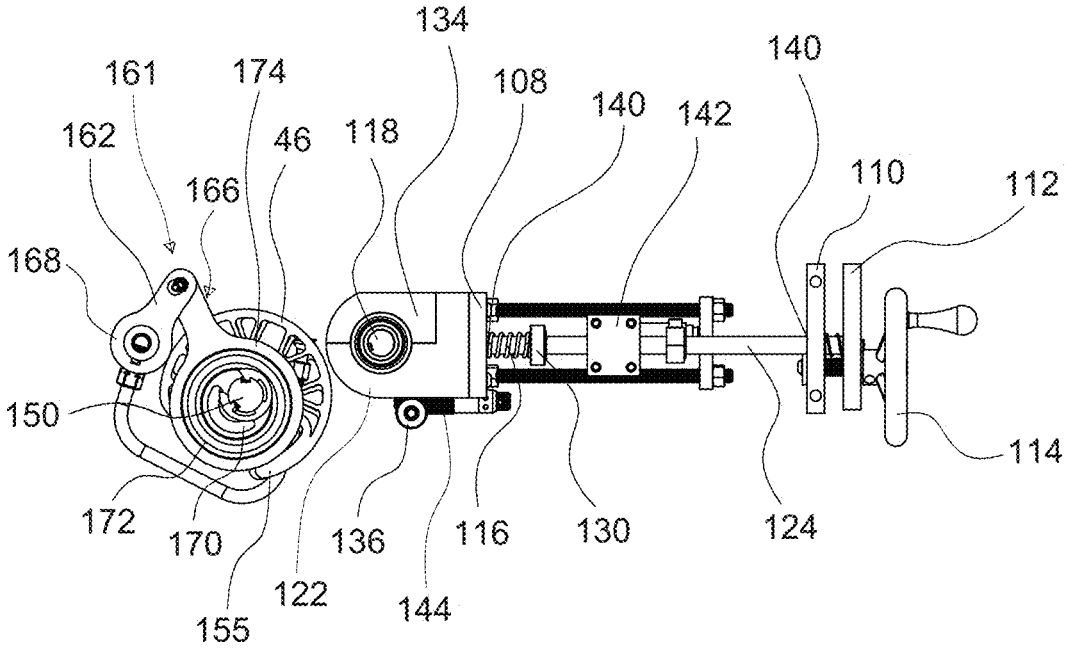
FIG. 4 is a front side view of the portions of the inserter hopper device shown in FIG. 3.
Figure 5:
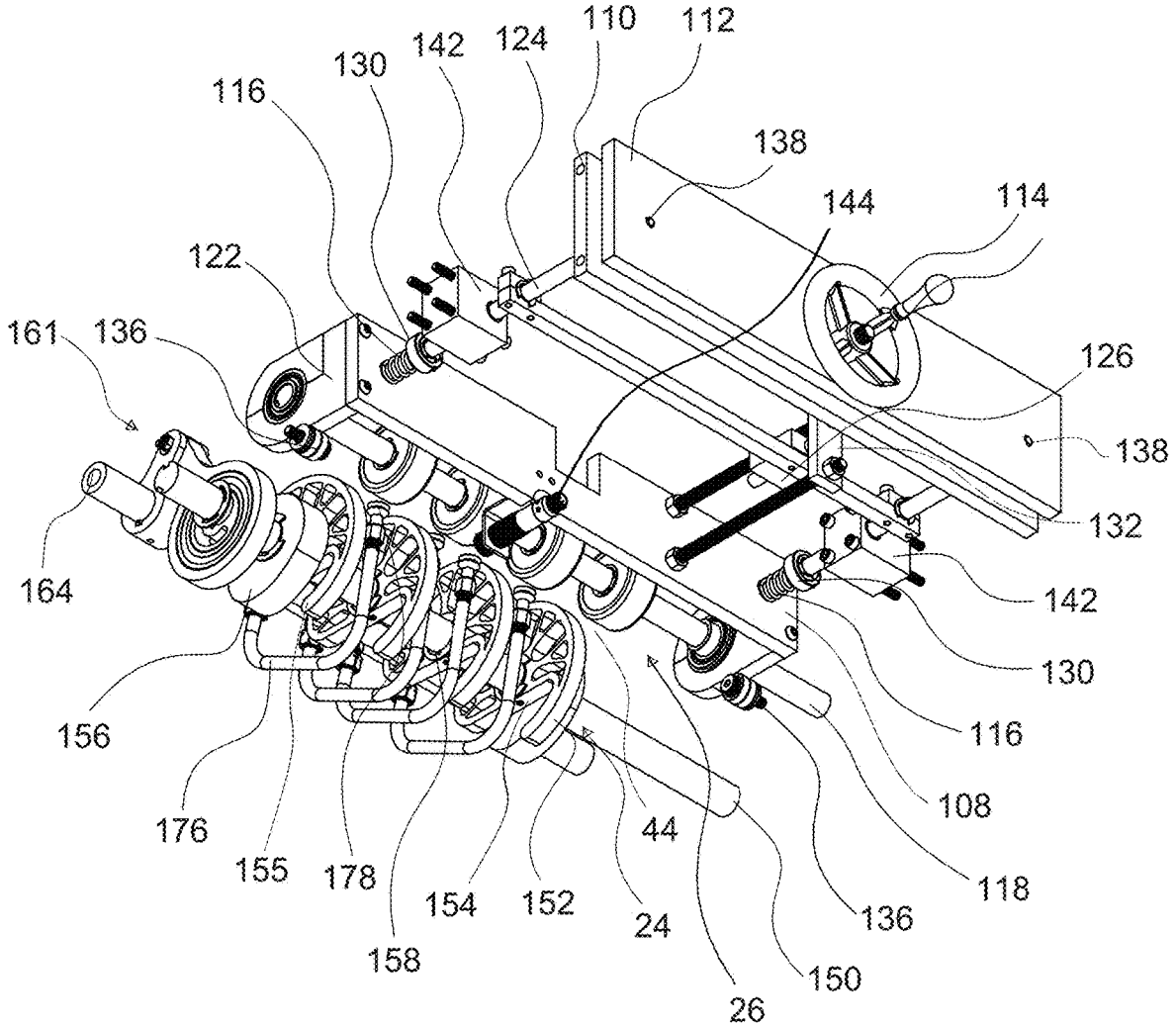
FIG. 5 is a front right lower perspective view of the portions of the inserter hopper device shown in FIGS. 3 and 4
Figure 6:
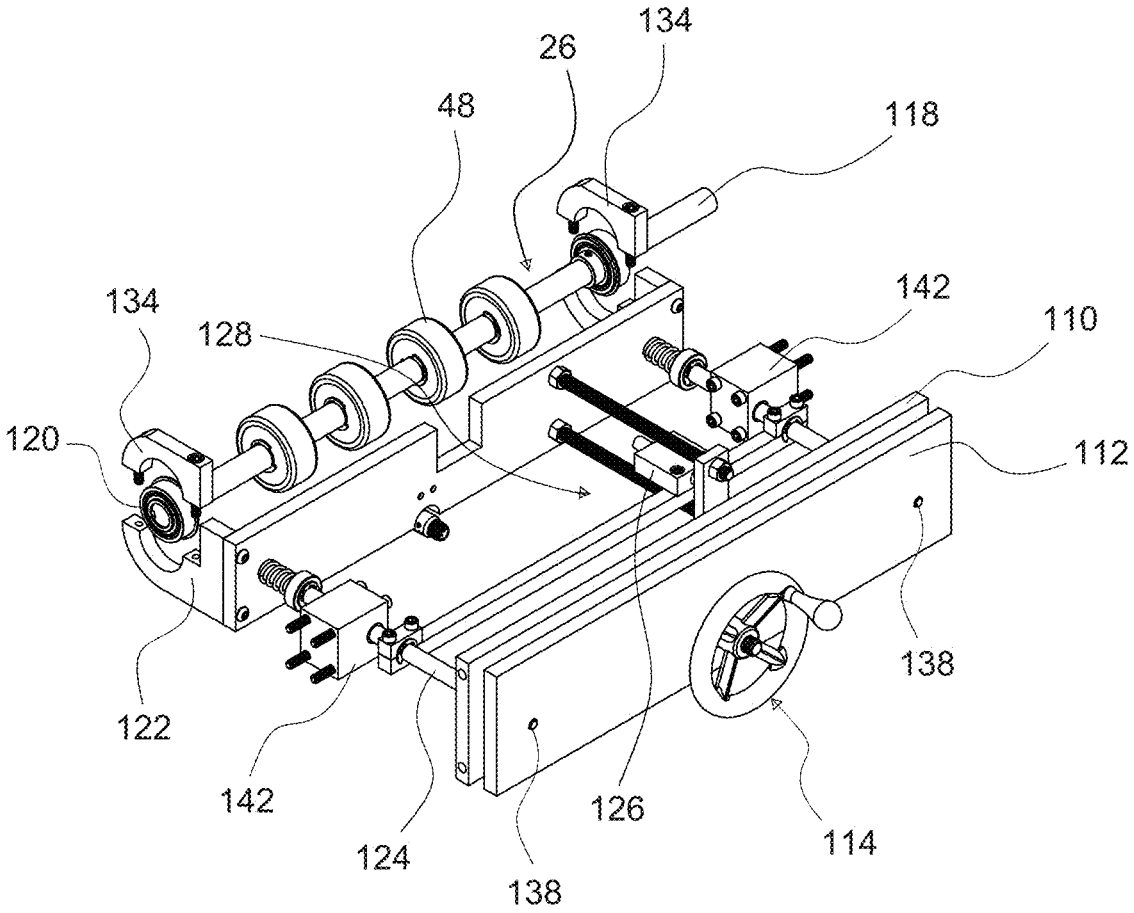
FIG. 6 is a front right upper perspective view of a portion of the inserter hopper device shown in FIGS. 1 and 2, and features the thickness tuning adjustment assembly and the carry-down roller assembly.

As seen in FIGS. 4 and 5, the carry-down roller assembly 26 also rests upon a pair of bearings 136. In addition to providing support for the carry-down roller assembly 26, the bearings 136 act to reduce friction associated with the rapid linear acceleration of the carry-down roller assembly 26 when the inserter hopper device 2 inadvertently feeds multiple inserts at a time into the nip 44. Vertical forces associated with the thickness tuning adjustment assembly 22 are supported by bearings 136 and the fixed back plate 110. This reduces the vertical load on the side rods 124, so as to permit the use of bushings instead of more expensive linear bearings in conjunction with the side rods 124.

As such, the side rods 124 are fixedly connected at their front ends 138 to the movable plate 112. The side rods 124 extend rearward and pass through and are slidable relative to openings through the fixed back plate 110 and through bushings 140 that are connected to the back plate 110 of the thickness tuning adjustment assembly 22. Each side rod 124 also extends further rearward and slidably passes through a fixed bushing assembly 142 on each side of the thickness tuning adjustment assembly 22. The bushing assemblies 142 are fixedly connected to the front and rear frames 6 of the framework 4 of the inserter hopper device 2, and are sufficient to allow for proper setup of the thickness tuning adjustment assembly 22 and carry-down roller assembly 26. The carry-down roller shaft support plate 108 slides along the side rods 124 by using another pair of bushings 140 that are connected to the carry-down roller shaft support plate 108. The side rods 124 do not move during normal operation, so only one pair of bushings 140 is required to allow movement of the carry-down roller shaft support plate 108 along the side rods 124, in the event that multiple inserts simultaneously pass through the nip 44.

As may be seen in at least FIGS. 3-5, the carry-down roller assembly 26 also acts as a foundation for a miss sensor 144 that is connected to and positioned below the carry-down roller shaft support plate 108. The miss sensor 144 provides real-time feedback with respect to detecting any instances during operation when an insert has not passed through the nip of the inserter hopper device 2. The miss sensor 144 may be of a photo-eye type which senses whether or not it sees its reflection. A middle carry-down cam 46 may have a reflective surface, such as may be provided by a piece of reflective tape, along the side of its web 160. The miss sensor 144 may be mounted opposite the reflective surface, such that if inserts are being fed through the inserter hopper device 2 in a normal manner, the miss sensor 144 will not see its reflection in the reflective surface because the inserts will be passing therebetween. However, if a cycle is missing an insert, the miss sensor 144 will see its reflection in the reflective surface and provide a signal indicating an event of a missed insert.

Carry-Down Cam and Sucker Assemblies

The carry-down cam assembly 24 includes the plurality of individual carry-down cams 46, best seen in FIGS. 3-5, 10 and 11, which are connected to a carry-down cam shaft 150. Each carry-down cam 46 has an outer contact surface 152 that is not circular and instead includes a relief 154 to accommodate separation from an insert that has been moved through the nip 44. The relief 154 also is configured so as to provide a finger 155, best seen in FIGS. 4, 5 and 14, which helps to initially drive an insert toward the nip 44 after the insert has been pulled downward by the sucker assembly 28. Preferably, counterweights 156 are connected to the carry-down cam shaft 150 to compensate for the reliefs 154 in the cams 46, so as to dynamically balance the carry-down cam assembly 24.

The carry-down cams 46 also are designed to try to minimize their overall weight while maintaining structural integrity. As such, the carry-down cams 46 preferably are not constructed with a continuous planar web between a central opening 158 and the outer contact surface 152. Instead, a web 160 includes numerous openings. The outer contact surface 152 of each carry-down cam 46 preferably is coated with either a diamond plate layer or a tungsten-carbide layer, depending on preference and cost, to increase friction with the individual inserts and to reduce the potential buildup of ink, dust and other impurities. However, it will be appreciated that alternative surface finishes may be utilized.

Figure 10:
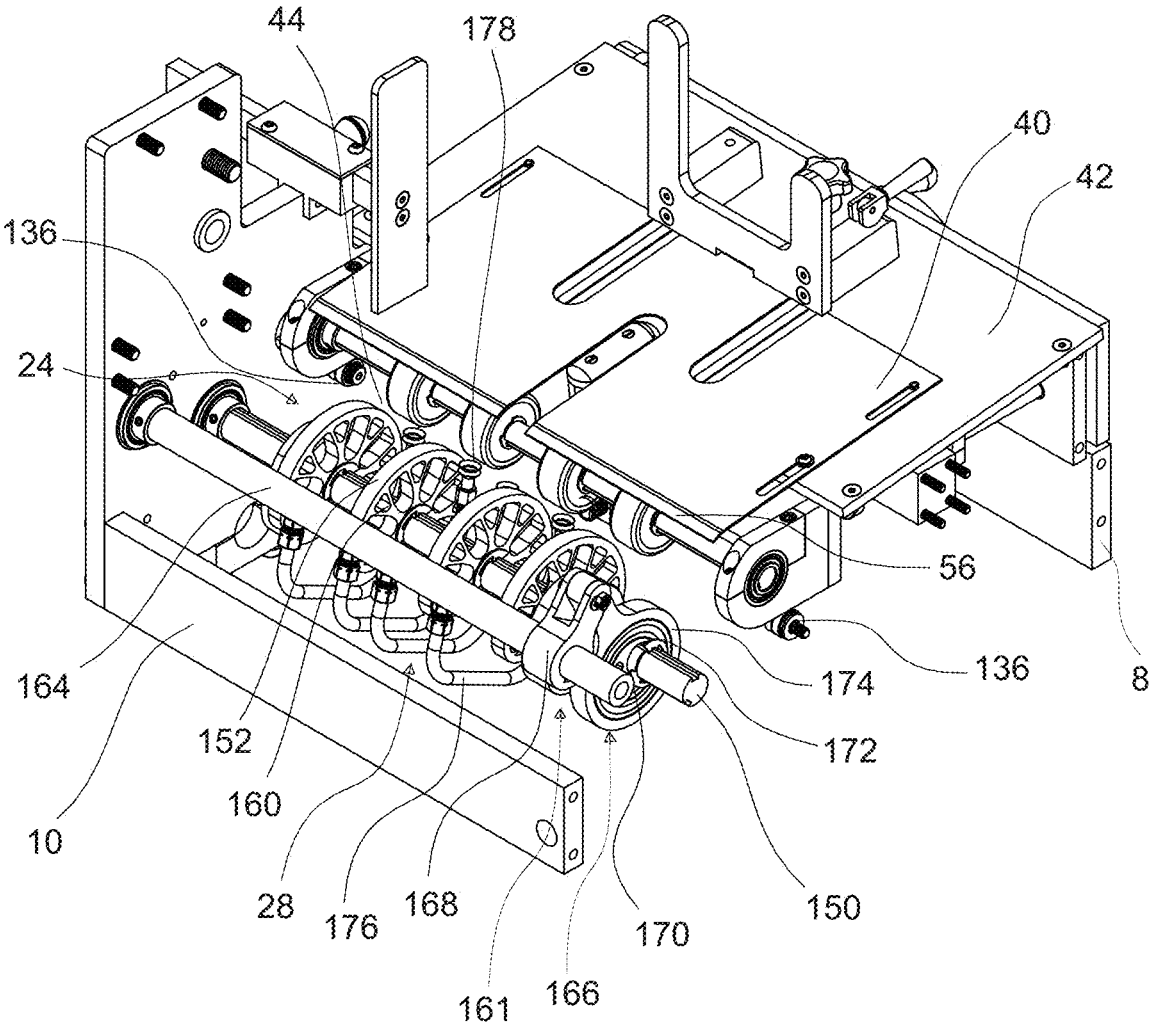
FIG. 10 is a front left upper perspective view of portions of the inserter hopper device shown in FIGS. 1 and 2, and features portions of the framework, the adjustable belly plate and support plate, the front guide, the thickness tuning adjustment assembly, the carry-down cam assembly, the carry-down roller assembly and the sucker assembly.
Figure 11:
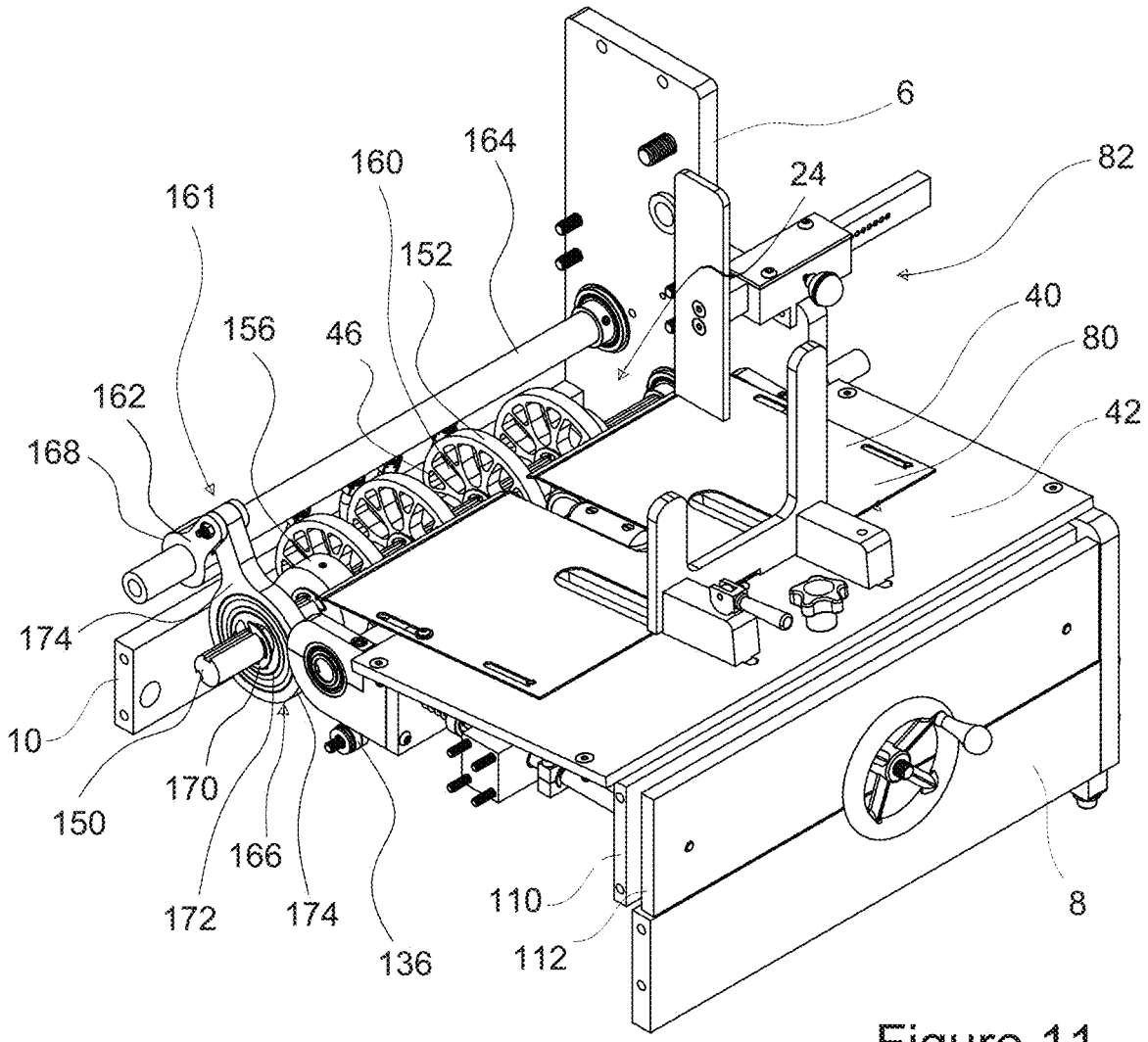
FIG. 11 is a front right upper perspective view of the portions of the inserter hopper device shown in FIG. 10.
Figure 12:
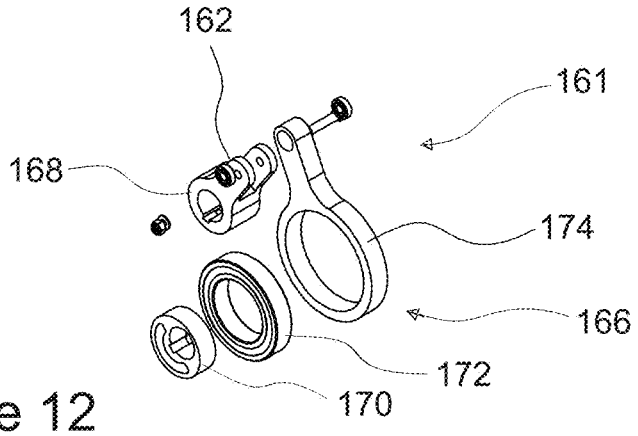
FIG. 12 is a front right upper perspective view of a portion of the inserter hopper device shown in FIG. 1, and features an eccentric strap and sheave assembly.

The plurality of individual carry-down rollers 48 on the carry-down roller shaft 118 are positioned opposite the respective plurality of individual carry-down cams 46 on the carry-down cam shaft 150. The carry-down roller shaft 118 and the carry-down cam shaft 150 are rotated by a main drive belt 146, shown in FIG. 2. As seen in FIGS. 10-12, the rotational motion of the carry-down cam shaft 150 is translated to a rocking or reciprocating arc motion of a sucker assembly 28 by a drive assembly 161, which may be seen in FIGS. 3-5, 10-12 and 14.

As seen in FIGS. 4 and 11-12, the translation of motion is achieved by the drive assembly 161, which in this example includes a link 162 that is coupled at a first end to a main sucker shaft 164 of the sucker assembly 28, and that is pivotally connected at a second end to an eccentric strap and sheave assembly 166 that is further coupled to the carry-down cam shaft 150. The first end of the link 162 includes a collar 168 that is coupled to the main sucker shaft 164, such as by use of a key and keyway, clamping force or other suitable means of coupling. The sheave end of the strap and sheave assembly 166 includes an eccentric wheel 170 inserted into a roller bearing 172, which is encased inside a strap housing 174, with the eccentric wheel 170 being coupled to the carry-down cam shaft 150, such as by use of a key and keyway, clamping force or other suitable means of coupling. The strap end of the strap and sheave assembly 166 is pivotally connected to the link 162. The roller bearing 172 may be, for example, a self-aligning CARBO toroidal bearing. The strap housing 174 may be of unitary construction or may include two or more portions that together hold and protect the roller bearing 172.

As seen in FIG. 10, the sucker assembly 28 includes the main sucker shaft 164, which is hollow and extends laterally, a plurality of tubular sucker stems 176, each of which is a bent tube in fluid communication with the hollow main sucker shaft 164 and has an enlarged distal sucker port 178. The main sucker shaft 164 is hollow to facilitate communication of vacuum or compressed air through the sucker stems 176 and sucker ports 178.

Vacuum and Back-Blast Assembly

Figure 13:
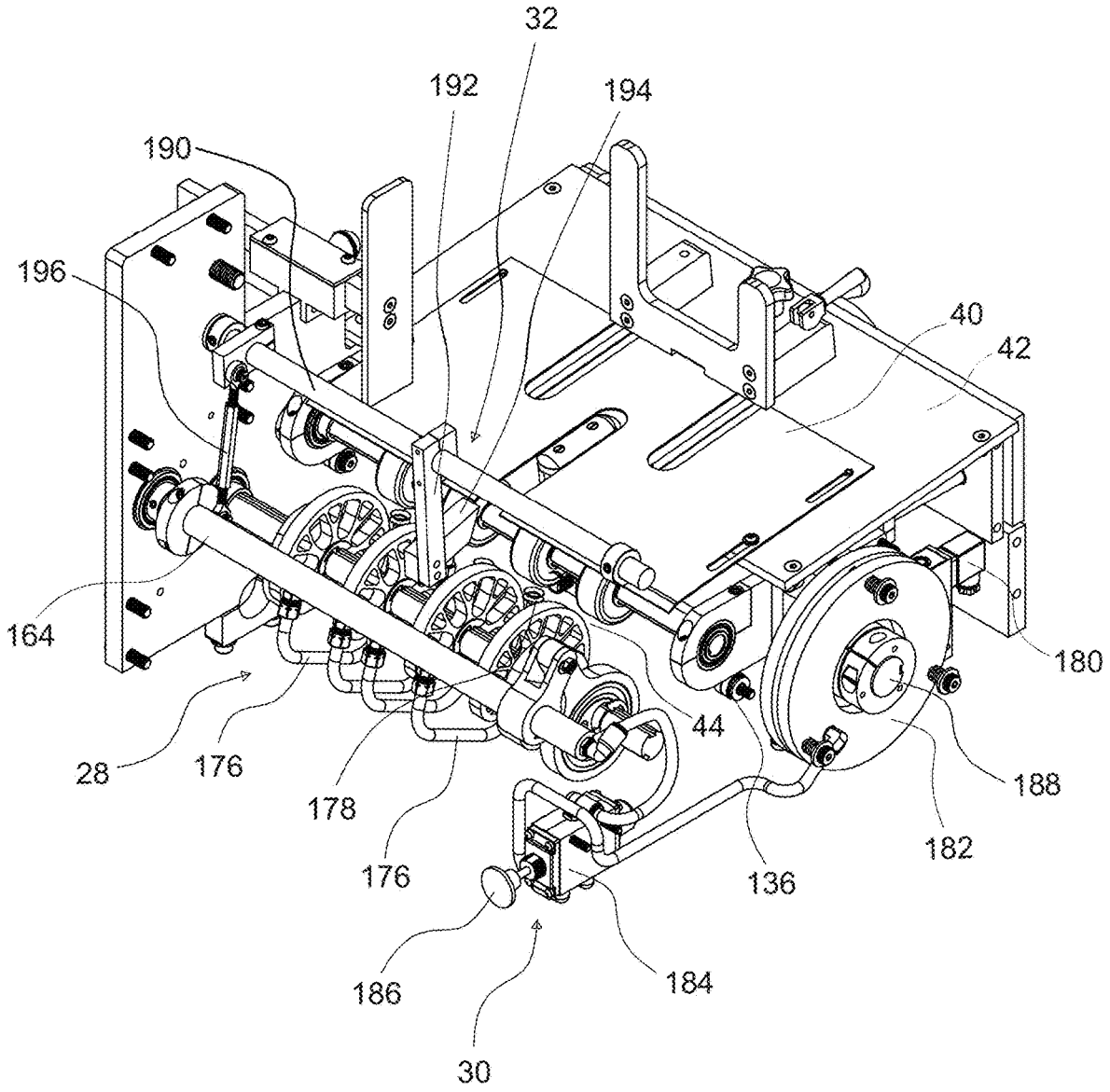
FIG. 13 is a front left upper perspective view of portions of the inserter hopper device shown in FIGS. 1 and 2, and features portions of the frame, the adjustable belly plate and support plate, the thickness tuning adjustment assembly, the carry-down cam assembly, the carry-down roller assembly, the sucker assembly, the vacuum and back blast assembly and the front pile lift assembly.
Figure 14:
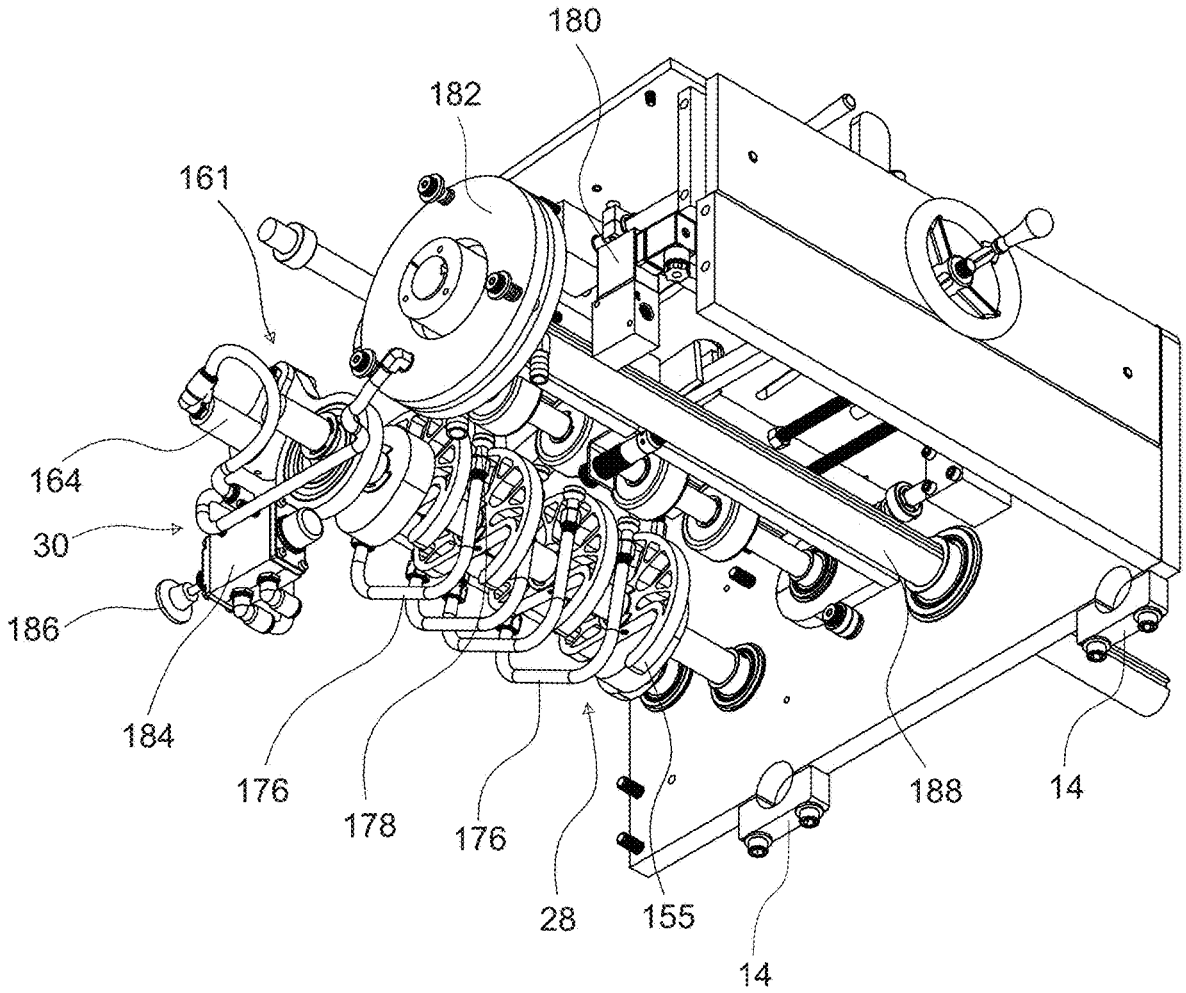
FIG. 14 is a front right lower perspective view of the portions of the inserter hopper device shown in FIG. 13.

A vacuum and back-blast assembly 30 is best seen in FIGS. 13 and 14. Vacuum is supplied to the inserter hopper device 2 from an external vacuum pump (not shown for ease of viewing the major components of the device 2). Vacuum first travels through a solenoid valve 180, which may be used to cut-off vacuum to the inserter hopper device 2 when the device needs to inhibit the pulling of the next insert from the bottom of the pile of inserts, or when the device 2 simply is not to be used during production. If the inserter hopper device 2 is configured for use, vacuum travels through the solenoid valve 180 and then to a vacuum disk assembly 182. The vacuum disk assembly 182 is a rotational valve that is driven on a connecting shaft 188 and causes vacuum to be turned on and off at the distal sucker ports 178. The connecting shaft 188 is driven by a coupling to the main inserting or bindery machine atop which the inserter hopper device 2 is mounted. In turn, the connecting shaft 188, the carry-down roller shaft 118 and the carry-down cam shaft 150 are rotatably connected by the main drive belt 146, with the main drive belt 146 and respective pulleys having toothed configurations, so as to synchronize the use of vacuum with the movement of the other assemblies to effect pull down of one insert at a time. The rear frame 6 has a slotted opening for the carry-down roller assembly shaft 118, because it may move slightly fore and aft to accommodate an inadvertent multiple or miss feed. As a result, the inserter hopper device 2 advantageously includes an idler pulley 148 to accommodate movement of the carry-down roller shaft 118 and ensure proper tension within the main drive belt 144.

Prior to vacuum being drawn through the main sucker tube 164, vacuum passes through a two-port valve 184. The two-port valve 184 includes a plunger 186. When the plunger 186 is retracted, such that the valve 184 is in its normally open position, vacuum is being used and is drawn through the vacuum and back blast assembly 30 and through the sucker assembly 28. When the plunger 186 is depressed, instead of applying vacuum, compressed air flows through the valve 184 and exits through the plurality of individual sucker ports 178. Thus, a back-blast of air may be directed through the sucker ports 178 and sucker stems 176 to remove contaminants from the sucker ports 178 and sucker stems 176. In addition, it will be appreciated that the vacuum and back blast assembly 30 alternatively may use a solenoid valve, in place of the vacuum disk assembly 182, to provide intermittent communication of vacuum or compressed air to the sucker assembly 28.

Front Pile Lift Assembly

A front pile lift assembly 32 is best seen in FIGS. 1, 2 and 13 and includes a front pile lift shaft 190, a front pile lift arm 192 and a lift foot 194. The front pile lift shaft 190 is connected to an upper first end of the front pile lift arm 192. The opposed lower second end of the front pile lift arm 192 is connected to the lift foot 194. As may be appreciated in FIG. 13, the front pile lift assembly 32 is driven in a rocking or reciprocating arc motion via a linkage 196 that is pivotally connected at a first end to the front pile lift shaft 190 and at an opposed second end to the main sucker tube 164. The configuration of the pivotal connections of the linkage 196 result in the respective rocking or reciprocating arc motions of the front pile lift assembly 32 and the sucker assembly 28 being synchronized and opposite to each other. Also in opposed synchronization is a front needle 198, best seen in FIG. 1. Thus, in a first position shown in FIG. 1, when the lift foot 194 is in a position to be providing support under the front of the pile of inserts that rest on the belly plate 40, the front needle 198 is withdrawn from the pile of inserts and a plurality of sucker ports 178 that are connected to the main sucker shaft 164 via sucker stems 176 are in a lowered position that would follow drawing an insert downward into the nip 44. Conversely, when the lift foot 194 is in a second position retracted away from the pile of inserts, the front needle 198 is inserted into the pile of inserts to help provide support, and the sucker ports 178 are moved to a raised position to engage the next insert on the bottom of the pile of inserts.

Stripper Finger Assembly

The framework 4 of the inserter hopper device 2 includes the front guide 18 that is best seen in FIG. 1. The front guide 18 provides a solid front surface that acts as a zero point and stop for the front of the pile of inserts. As best seen in FIG. 15, behind the front guide 18 is an adjustable stripper finger assembly 34. The adjustable stripper finger assembly 34 includes a rear support plate 200 and a front support plate 202, each of which is connected to the framework 4 and supports a plurality of stripper finger adjustment assemblies 204. The plurality of stripper finger adjustment assemblies 204 are configured to correspond to the plurality of carry-down cams 46 and to assist in separating an insert that has been pulled from the bottom of the pile of inserts from the carry-down cams 46.

Each of the plurality of stripper finger adjustment assemblies 204 includes a stripper adjustment rod 206 that is supported by the rear and front support plates 200, 202, and is connected at its rear end to a stripper finger knob 208. The stripper finger knob 208 may be rotated, with the rotational motion being translated through the respective stripper finger adjustment rod 206 to a linear motion to advance or retract a stripper finger block 210 inward or outward relative to the stack of inserts. Thus, each stripper adjustment rod 206 preferably threadably engages a threaded aperture through a stripper finger block 210. In turn, a plurality of individual stripper fingers 212 is connected to the respective plurality of stripper finger blocks 210. The plurality of individual stripper fingers 212 is located in close proximity to the respective plurality of carry-down cams 46 and extends to outside of the guards for the inserter hopper device 2. This allows for better viewing and fine-tuning adjustment of each stripper finger 212, while the inserter hopper device 2 is operating. Accordingly, each stripper finger 212 may be individually adjusted to advantageously enhance release of the inserts from each carry-down cam 46. Each stripper finger knob 208 also may be of a "detent" style that clicks into rotational positions about a central axis of the stripper finger knob 208, so as to provide for very fine fore and aft adjustment of the front tips of the respective stripper fingers 212.

The above structures facilitate a unique and highly advantageous method of device setup that is convenient and significantly reduces the time required to adjust an inserter hopper device so as to be ready for operation. For example, the inserter hopper device 2 provides for an operator to perform a method of setting up an inserter hopper device 2 to handle a selected pile of inserts that includes a few steps that may be completed within one minute. The steps of the method of setting up an inserter hopper device to handle a selected pile of inserts includes: a) obtaining a selected pile of inserts to be handled by the inserter hopper device 2; b) adjusting the fore and aft position of the belly plate 40 relative to the framework 4 by moving the belly plate 40 toward or away from the front guide 18, as desired; c) assessing the size of the obtained pile of inserts relative to the position of the front guide 18, rear guide 80 and side guides 82; d) locating the front guide 18, rear guide 80, and the side guides 82 so as to be sufficiently spaced apart respectively to receive the pile of inserts on the belly plate 40 and between the front guide 18, rear guide 80 and side guides 82; d) placing the pile of inserts onto the belly plate 40 between the front guide 18, rear guide 80 and side guides 82, while attempting to generally center the pile of inserts relative to the side guides 82 and to move the pile of inserts forward to contact the front guide 18; e) locating the side guides 82 so as to be proximate but not contacting the respective sides of the pile of inserts; f) locating the rear guide 80 so as to be in contact with the pile of inserts; and g) removing one insert from the pile of inserts and placing the one insert in the thickness tuning adjustment assembly 22 between the back plate 110 and movable plate 112, and adjusting the clamping mechanism 114 to trap the one insert between the back plate 110 and movable plate 112, so as to automatically set a nip distance at the nip 44 between the plurality of carry-down cams 46 of the carry-down cam assembly 24 and the plurality of carry-down rollers 48 of the carry-down roller assembly 26, and thereby achieving setup of the inserter hopper device 2 to handle the pile of inserts.

In the above method of setting up an inserter hopper device 2 to handle a selected pile of inserts, the steps may invoke additional considerations. For example, when adjusting the fore and aft position of the belly plate 40 relative to the framework 4, the operator may consider that a lack of stiffness of the individual inserts in the pile of inserts may make it desirable to move the belly plate 40 toward the front guide 18 to increase stiffness in the cantilevered portion of the inserts that extend forward from the belly plate 40, or that abundant stiffness of the individual inserts in the pile of inserts may make it desirable to move the belly plate 40 further away from the front guide 18 to decrease stiffness in the cantilevered portion of the inserts that extend forward of the belly plate 40. Similarly, depending upon the outside dimensions of the inserts previously handled by the inserter hopper device 2, the area between the front guide 18, rear guide 80 and side guides 82, respectively, may prompt the operator to move the respective guides to increase the area to place the pile of inserts onto the belly plate 40. Accordingly, if the inserts are larger than those previously handled, the operator will move the respective rear and side guides outward to permit more space to receive the pile of inserts. Also, when moving the side guides 82 toward the pile of inserts that has been placed on the belly plate 40, the operator seeks to avoid having the side guides 82 contact the sides of the pile of inserts, so as to ensure ease of placement of subsequent piles of inserts into the inserter hopper device 2 and to avoid drag on the inserts while in operation. However, the rear guide 80 is moved into contact with the rear of the pile of inserts, so as to ensure that the front of the pile of inserts will be in contact with the front guide 18 at all times.

Depending on the way in which the inserter hopper device 2 is equipped, the method of setting up the device 2 may include two optional additional steps that may be employed, including h) adjusting a front saddle assembly 16 with respect to the height of a saddle 58 relative to the belly plate 40 and a desired bow at the front of the bottom of the pile of inserts; and i) adjusting a stripper finger assembly 34 with respect to a position of stripper fingers 212 relative to a contact surface of the carry-down cams 46 so as to enhance release of the inserts from the carry-down cams 46. Depending on the prior inserts that were handled by the inserter hopper device 2, the operator may or may not choose to adjust either of these assemblies, and it should be noted that these two assemblies may be adjusted during operation, so as to fine tune handling of the inserts.

A major advantage provided by the improved method for setting up the inserter hopper device 2 may be best understood when one considers, for example, that there may be 10 inserter hopper devices atop a high speed inserting machine that need to be readjusted to receive and handle the next set of inserts. Accordingly, with the time required for setup of the 10 inserter hopper devices 2 potentially being around 10 minutes, instead of as much as 300 minutes that may be required for setup of typical prior art inserter hopper devices, the result of the faster and more convenient new method of setting up the inserter hopper devices 2 may be significantly greater productive utilization of the high speed inserting machine supplied by the inserter hopper devices.

In addition to the new method of setting up an inserter hopper device 2, the above structures provide significant advantages with respect to operation of an inserter hopper device 2. Operation of the inserter hopper device 2 follows coupling the shaft 188 of the inserter hopper device 2 to a drive element of a host machine that is positioned below the inserter hopper device, and using a toothed belt and a corresponding toothed pulley on the shaft 188 to drive and synchronize respective toothed pulleys on the carry-down cam shaft 150 and the carry-down roller shaft 118. Operation also requires the above setup of the inserter hopper device 2, resulting in a pile of inserts being placed on the belly plate 40 and the rear guide 80 and side guides 82 being adjusted accordingly. With those items accounted for, the method of operation includes the following steps: a) providing synchronized rotation of the respective shafts 188, 118 and 150, resulting in rotation of a vacuum disk assembly 182, a carry-down roller assembly 26 and a carry-down cam assembly 24, respectively; b) the rotation of the carry-down cam shaft 150 of the carry-down cam assembly further driving reciprocating pivotal movement of a front pile lift shaft 192 of a front pile lift assembly 32 and driving reciprocating pivotal movement of a main sucker shaft 164 of a sucker assembly 28; c) the reciprocating movement of the front pile lift shaft 192 moving a lift foot 194 on a front pile lift arm 92 that is connected to the front pile lift shaft 192 between a first position proximate the belly plate 40 and below the pile of inserts and a second position forward of the pile of inserts sufficiently to permit an insert to move toward and through the a nip between a plurality of carry-down cams 46 on the carry-down cam shaft 150 and a plurality of rollers 48 on the carry-down roller shaft 118; d) the reciprocating movement of the main sucker shaft 164 moving sucker ports 178 on sucker stems 176 that extend between the main sucker shaft 164 and the sucker ports 178 between a first position spaced away from the nip and in contact with an insert on the bottom of the pile of inserts and a second position wherein the sucker ports have drawn the insert to a location proximate the nip; e) the rotation of the shaft 188 operating the vacuum disk assembly 182 turns on vacuum for communication with the sucker ports 178 when the sucker ports 178 are in the first position spaced from the nip 44 to create adhesion to the bottom insert in the pile of inserts; f) the main sucker shaft 164 moves the sucker ports 178 so as to pull the front portion of the insert downward toward the nip 44 as the sucker ports 178 move from the first position to the second position; g) the rotation of the shaft 188 operating the vacuum disk assembly 182 turns off vacuum and momentarily turns on compressed air for communication with the sucker ports 178 to release the hold of the insert; h) the plurality of carry-down cams 46 contact and drive the insert into the nip 44; i) the plurality of carry-down cams 46 and carry-down rollers 48 grasp the insert and drive the insert through the nip 44.

It will be appreciated that this method of operation relies on synchronization of the respective shafts and assemblies connected thereto. This is facilitated in part by use, for example, of an eccentric strap and sheave assembly 166 by which the carry-down cam shaft 150 drives the reciprocating motion of the main sucker shaft 164. This similarly is facilitated by use, for example, of a linkage 196 by which the carry-down cam shaft 150 drives the reciprocating motion of the front pile lift shaft 190. As noted above, the function of the rotating vacuum disk assembly 182 alternatively may be provided by a solenoid valve that may permit more variation in adjustment of the timing of application of the vacuum and compressed air.

It also will be appreciated that as the insert is driven by the rotation of the carry-down cams 46 and carry-down rollers 48 through the nip 44 at the bottom of the inserter hopper device 2, the insert shoots into a jacket, for example, if mounted to an inserting machine, or onto a raceway, for example, if mounted on a collator or mail table. In addition, each carry-down cam 46 includes a relief 154 which also forms a finger 155 that is used to help the carry-down cam 46 drive the insert into the nip 44. Thus, as soon as the sucker ports 178 pull the front edge of the insert below the trajectory of the withdrawn front pile lift foot 194, the lift foot moves toward the first position to return to extending below the pile of inserts to support the pile. Use of the reciprocating needle 198 to stick into the pile of inserts spaced upward from the bottom of the pile of inserts and synchronized in opposition to the motion of the front pile lift foot 194 moving under the pile of inserts helps to ensure that the front of the pile of inserts receives at least some additional support at all times, while still permitting successive inserts to be removed from the bottom of the pile.

Although the present subject matter is described herein with reference to specific structures, methods and examples, this is for purposes of illustration only, and it is understood that the present subject matter is applicable to a large range of devices that may differ in particular configuration and appearance while still employing this subject matter. This patent is only limited by the appended claims and legal equivalents thereof.

The invention claimed is:

1. An inserter hopper device for handling a pile of inserts comprising:

a framework;

a belly plate that is connected to the framework;

a carry-down cam assembly including a plurality of carry-down cams on a rotatable carry-down cam shaft having a fixed location relative to the framework;

a carry-down roller assembly including a plurality of carry-down rollers on a rotatable carry-down roller shaft having a location that is movable relative to the framework in the fore and aft directions;

the plurality of carry-down rollers being opposed to and spaced from the plurality of carry-down cams so as to provide a nip having a nip distance between the respective plurality of carry-down rollers and plurality of carry-down cams, and the inserts are moved through the nip individually;

wherein at least one biasing element biases the movable carry-down roller shaft toward the nip;

a thickness tuning adjustment assembly that moves the carry-down roller assembly so as to adjust the nip distance;

a vacuum assembly that is in communication with a movable sucker assembly that has sucker ports being movable toward and away from the nip; and wherein the thickness tuning adjustment assembly further comprises a back plate that is in a fixed position relative to the framework and a movable plate that is movable in fore and aft directions toward and away from the back plate.

2. The inserter hopper device of claim 1, wherein the belly plate is adjustable relative to the framework in fore and aft directions.

3. The inserter hopper device of claim 2, wherein the belly plate is slidably adjustable relative to a support plate that is connected to the framework.

4. The inserter hopper device of claim 3, wherein the adjustable belly plate and support plate assembly further comprises a front saddle assembly having a saddle that is vertically adjustable relative to the belly plate and support plate.

5. The inserter hopper device of claim 4, wherein the saddle is movable upward through respective openings in the belly plate and support plate to contact the pile of inserts.

6. The inserter hopper device of claim 1, wherein the framework further comprises a front guide to locate the pile of inserts on the belly plate and relative to the framework.

7. The inserter hopper device of claim 1, further comprising an insert pile guide assembly having side guides and a rear guide to locate the pile of inserts on the belly plate and relative to the framework.

8. The inserter hopper device of claim 1, wherein the side guides and a rear guide of the insert pile guide assembly are connected to the framework and adjustable relative to the framework.

9. The inserter hopper device of claim 1, wherein the movable plate is connected to side rods that move with the movable plate and are slidable relative to the framework, and wherein setting a distance between the movable plate and back plate simultaneously sets the nip distance.

10. The inserter hopper device of claim 1, wherein setting the distance between the movable plate and back plate includes placing one of the inserts between the movable plate and the back plate and then using a clamping mechanism to move the movable plate toward the back plate.

11. The inserter hopper device of claim 1, wherein the sucker assembly further comprises a main sucker shaft that pivots about a fixed location relative to the framework, wherein the main sucker shaft is hollow and the sucker assembly further comprises a plurality of sucker stems that extend from the main sucker shaft, and the sucker ports are located at the distal ends of the sucker stems.

12. The inserter hopper device of claim 11, further comprising a strap and sheave assembly being connected to the main sucker shaft and the carry-down cam shaft, wherein the sucker assembly has a reciprocating motion relative to the framework, and wherein the respective sucker ports reciprocate between a position proximate the nip and a position spaced further from the nip.

13. The inserter hopper device of claim 1, wherein the plurality of carry-down rollers further comprise a cylindrical outer contact surface, while the plurality of carry-down cams comprise a non-cylindrical outer contact surface.

14. The inserter hopper device of claim 13, wherein the non-cylindrical outer contact surface of the carry-down cams further comprise an inward extending relief.

15. The inserter hopper device of claim 1, further comprising a missed insert sensor that monitors whether the inserts successfully successively pass through the device.

16. The inserter hopper device of claim 15, wherein the missed insert sensor reacts to a difference between reflectivity of one of the inserts versus an outer contact reflective surface of one of the carry-down cams.

17. The inserter hopper device of claim 1, further comprising a stripper finger assembly that includes a plurality of individual stripper fingers proximate respective contact surfaces of the plurality of carry-down cams so as to enhance release of inserts from the plurality of carry-down cams.

18. The inserter hopper device of claim 17, wherein the stripper finger assembly further comprises at least one rotatable adjustment knob that drives a fore and aft position of a stripper finger block having at least one of the plurality of stripper fingers extending therefrom.

19. An inserter hopper device for handling a pile of inserts comprising:

a framework;

a belly plate that is connected to the framework;

a carry-down cam assembly including a plurality of carry-down cams on a rotatable carry-down cam shaft having a fixed location relative to the framework;

a carry-down roller assembly including a plurality of carry-down rollers on a rotatable carry-down roller shaft having a location that is movable relative to the framework in the fore and aft directions;

the plurality of carry-down rollers being opposed to and spaced from the plurality of carry-down cams so as to provide a nip having a nip distance between the respective plurality of carry-down rollers and plurality of carry-down cams, and the inserts are moved through the nip individually;

wherein at least one biasing element biases the movable carry-down roller shaft toward the nip;

a thickness tuning adjustment assembly that moves the carry-down roller assembly so as to adjust the nip distance;

a vacuum assembly that is in communication with a movable sucker assembly that has sucker ports being movable toward and away from the nip; and a vacuum and back blast assembly that includes a valve having a first position that places the sucker assembly in communication with a source of vacuum and having a second position that places the sucker assembly in communication with a source of compressed air.

20. An inserter hopper device for handling a pile of inserts comprising:

a framework;

a belly plate that is connected to the framework;

a carry-down cam assembly including a plurality of carry-down cams on a rotatable carry-down cam shaft having a fixed location relative to the framework;

a carry-down roller assembly including a plurality of carry-down rollers on a rotatable carry-down roller shaft having a location that is movable relative to the framework in the fore and aft directions;

the plurality of carry-down rollers being opposed to and spaced from the plurality of carry-down cams so as to provide a nip having a nip distance between the respective plurality of carry-down rollers and plurality of carry-down cams, and the inserts are moved through the nip individually;

wherein at least one biasing element biases the movable carry-down roller shaft toward the nip;

a thickness tuning adjustment assembly that moves the carry-down roller assembly so as to adjust the nip distance;

a vacuum assembly that is in communication with a movable sucker assembly that has sucker ports being movable toward and away from the nip;

a front pile lift assembly having a front pile lift shaft having a fixed location relative to the framework, wherein the front pile lift assembly pivots about the fixed location relative to the framework and further comprises a front pile lift arm extending downward from the front pile lift shaft and a front pile lift foot extending rearward from the front pile lift arm so as to be located below the pile of inserts; and a linkage being connected to the front pile lift shaft and the carry-down cam shaft so as to provide reciprocating motion of the front pile lift assembly relative to the framework, wherein the front pile lift foot reciprocates between a first forward position of the front pile lift foot and a second rearward position of the front pile lift foot.

* * * * *